US005330407A

United States Patent [19]

Skinner

[11] Patent Number: 5,330,407

[45] Date of Patent: Jul. 19, 1994

[54] EXERCISE METHOD AND APPARATUS UTILIZING ELASTOMERIC SPHERES

[75] Inventor: Mark J. Skinner, Montclair, Calif.

[73] Assignee: Spherepoint, Inc., Santa Cruz, Calif.

[21] Appl. No.: 699,771

[22] Filed: Aug. 19, 1991

[51] Int. Cl.[5] ..... A63B 21/15

[52] U.S. Cl. ..... 482/117; 482/114

[58] Field of Search ..... 482/114, 115, 117; 188/251 A, 74, 75, 71.1, 72.2

[56] References Cited

U.S. PATENT DOCUMENTS

| | | | |
|---|---|---|---|
| 642,862 | 2/1900 | Covell . | |
| 709,194 | 9/1902 | Bennett . | |
| 1,065,635 | 6/1913 | Sweet . | |
| 1,229,879 | 6/1917 | Buffat . | |
| 1,535,391 | 4/1925 | Anderson . | |
| 2,126,443 | 9/1938 | Begley . | |
| 2,209,254 | 7/1940 | Ahnger . | |
| 2,286,324 | 6/1942 | Wentz . | |
| 2,316,874 | 4/1943 | Kraft . | |
| 2,344,592 | 3/1944 | Brownlee . | |
| 2,682,776 | 7/1954 | Morgan . | |
| 2,687,546 | 8/1954 | Oppenheimer | 188/74 X |
| 2,817,524 | 12/1957 | Sadler . | |
| 2,848,883 | 8/1958 | Dall'Olio . | |
| 2,973,962 | 3/1961 | Griffin . | |
| 3,428,311 | 2/1969 | Mitchell . | |
| 3,554,045 | 1/1971 | Littmann . | |
| 3,782,721 | 1/1974 | Passera | 482/117 |
| 4,056,953 | 11/1977 | Furlette et al. . | |
| 4,208,047 | 6/1980 | Olsen . | |
| 4,344,615 | 8/1982 | Carlson . | |
| 4,401,208 | 8/1983 | Allmacher, Jr. . | |

FOREIGN PATENT DOCUMENTS

| | | | |
|---|---|---|---|
| 2195551 | 4/1988 | United Kingdom | 482/117 |

*Primary Examiner*—Richard J. Apley
*Assistant Examiner*—Lynne A. Reichard
*Attorney, Agent, or Firm*—George C. Limbach

[57] ABSTRACT

A controlled mechanical friction principle is disclosed utilizing elastomeric spheres. The spheres are grouped in radial or nested formation between at least two working surfaces and contained in such a manner that compression sliding friction occurs between spheres. A frictional resistance adjustment is provided by means controlling the degree to which the elastomeric spheres are compressed. A walled container has pliable balls arranged as a single covering therein against a back surface, and an opposing piston is structured to move freely within the container walls. The degree of adjustable contact made by the cylinder inner wall surfaces against the spheres regulates the applied frictional resistance. Variable degrees of power transfer or brakeage is developed between the container inner surface wall and the opposing cylinder inner surface wall with the compressed spheres as the passage medium.

8 Claims, 3 Drawing Sheets

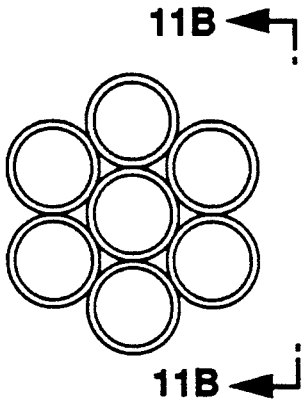
FIG. 11A
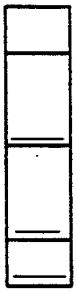
FIG. 11B
FIG. 8
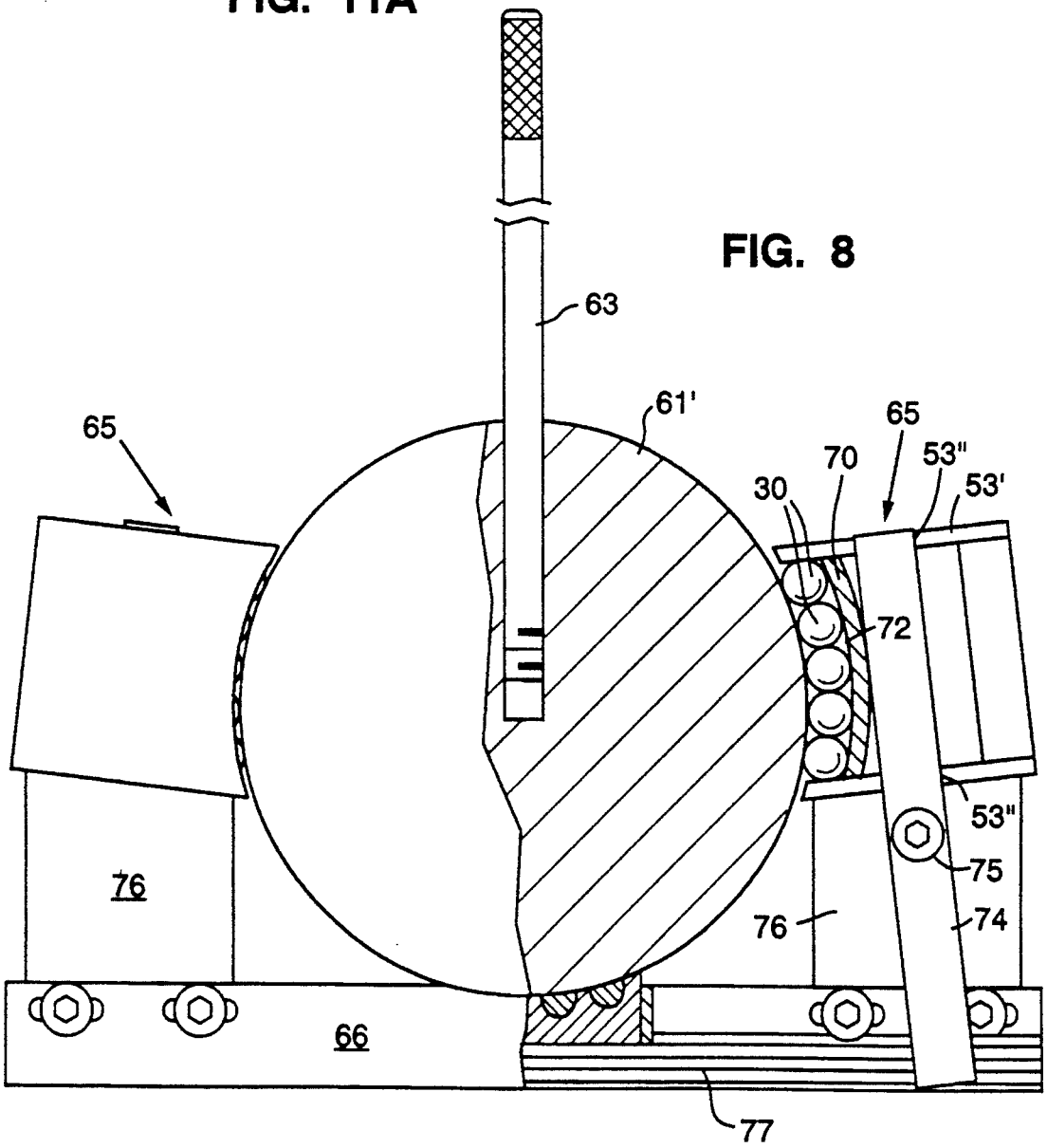

EXERCISE METHOD AND APPARATUS UTILIZING ELASTOMERIC SPHERES

FIELD OF THE INVENTION

This invention relates to exercise method and apparatus employing mechanical friction utilizing elastomeric spheres.

BACKGROUND OF THE INVENTION

Problems of controlled resistance occurred during my attempts to devise exercising equipment using a hard sphere set into a frame with a handle attached. Resolving controlled resistance problems seems to have been a major effort also in past art development. In a similar ball and handle exercising device, J.R. Anderson, U.S. Pat. No. 1,535,391, issued Apr. 28, 1925, tries to resolve the resistance problem with a ball in a tightenable socket. The J.G. Begley exercise device, U.S. Pat. No. 2,126,443, dated Aug. 9, 1938, also tightens a ball in a socket for resistance control. In U.S. Pat. No. 2,817,524, issued Dec. 24, 1957, to H.K. Sadler, the same problem is approached differently in that two soft washers tighten down on a disc to provide the controlled resistance. But in U.S. Pat. No. 3,428,311, dated Feb. 18, 1969, to T.J. Mitchell, we again see the ball in a tightenable receptacle. The C.H. Carson U.S. Pat. No. 4,344,615 describes a controlled friction exercising device using pressure applied to the cylindrical central portion of a bar.

In further developing my use of elastomeric spheres in the present invention, the state-of-the-art for other uses was viewed. In a power transmitting device shown by H.N. Coyell, U.S. Pat. No. 642,862, dated Feb. 6, 1900, friction drums encasing ball bearings is the clutching mechanism. A friction clutch is illustrated by G.M. Bennett in a patent issued Sep. 16, 1902, U.S. Pat. No. 709,194. In the E.J. Sweet U.S. Pat. No. 1,065,635, of Jun. 24, 1913, wedged rollers are used in his clutch. A frictional type ball gearing is disclosed in the W.E. Buffat device, U.S. Pat. No. 1,229,879, issued Jun. 12, 1917, and a friction transmission device is disclosed in U.S. Pat. No. 2,209,254, dated Jul. 23, 1940, issued to Y.A. Ahnger. A massage roller in which a pair of soft balls are frictionally engaged by handles is described in U.S. Pat. No. 2,286,324 issued to J.L. Wentz Jun. 16, 1942. U.S. Pat. No. 2,316,874, issued Apr. 20, 1943 describes a cone clutch devised by H.T. Kraft, and U.S. Pat. No. 2,344,592, dated Mar. 21, 1944, allowed to R.L. Brownless discloses a power take-off clutch.

A transmission is disclosed by P.S. Morgan in U.S. Pat. No. 2,682,776, dated Jul. 6, 1954, and a controlled torque coupling for converting rotary motion and using resiliently compressible tubular members is described by V. Dall'Olio in U.S. Pat. No. 2,848,883, issued Aug. 26, 1958. B.J. Griffin invented the exercising device with coiled springs described in U.S. Pat. No. 2,973,962, issued on Mar. 7, 1961, and J.C. Littman invented the momentary flexible, motor drive overload release device utilizing resilient rollers issued in U.S. Pat. No. 3,554,045 on Jan. 12, 1971. A torque limiting coupling utilizing resilient spherical members is described in U.S. Pat. No. 4,056,953, issued to J.L. Furlette on Nov. 8, 1977, and an exerciser and tension relieving device is described by G.P. Olsen in U.S. Pat. No. 4,208,047, issued Jun. 17, 1980. Finally, U.S. Pat. No. 4,401,208, issued Aug. 30, 1983 to D.S. Allmacher, Jr. describes an accumulating conveyor system utilizing torque limiting elastomeric rollers.

The foregoing, being the most pertinent devices disclosed in the prior art directly related to the present invention, do not disclose the use of elastomeric spheres for frictional control as advanced as the principle herein disclosed.

OBJECTS OF THE INVENTION

Therefore, it is a principal object of the present invention to provide a method and apparatus for adjustable friction useful in exercise equipment, clutches, and other devices which have a requirement for adjustable friction.

Another object of my invention is the provision of controlled friction using an elastomeric sphere system.

Other objects and the many advantages of this invention will become apparent with a reading of the included specification in relationship to the drawings and the numbered parts thereon.

SUMMARY OF THE INVENTION

This invention provides a new applied principle in the field of controlled mechanical friction. Using elastomeric spheres in any number or size combinations thereof, adjustable frictional control can be maintained in a variety of mechanical appliances. Mechanics using the principle disclosed are applicable to containers shaped square, round and tubular. My principle is also useful in numerous flat surface applications.

Broadly stated the present invention is directed to method and apparatus wherein at least one elastomeric sphere is located between a first engaging surface of a first member and a second engaging surface of a second member with the sphere in contact with the first and second engaging surfaces and means for moving the first and second surfaces relative to one another and/or for moving the sphere relative to at least one or the first and second members. Friction between the sphere and the first and second engaging surfaces provides resistance to the relative movement of the first and second members.

In accordance with an aspect of the present invention a means and step are provided for moving the first and second members relative to one another in the direction of the shortest distance between the first and second surfaces to change the compression on the sphere by the first and second members and thereby change the friction between the sphere and the first and second surfaces.

In accordance with another aspect of the present invention and in the preferred embodiment thereof, a plurality of elastomeric spheres are located between the first and second members and are laterally confined in the space between the first and second engaging surfaces such that each of the spheres is not only in contact with the first and second engaging surfaces, but also in contact with at least one other sphere. In accordance with this aspect of the present invention relative movement of the first and second members causing the surface of the spheres to move with respect to the first and second members results in rolling and/or sliding friction between the spheres and the first and second engaging surfaces as well as sliding friction between the spheres in contact with one another.

In accordance with another aspect of the present invention and the preferred embodiment thereof, the first and second engaging surfaces are positioned substantially parallel to one another. Alternatively, and in accordance with another aspect of the present invention at least one of the engaging surfaces is substantially hemispherical.

In accordance with still another aspect of the present invention, the method and means for moving the first and second members relative to one another comprises method and means for moving one of the first and second engaging surfaces in a direction parallel to the plane of the other of the first and second engaging surfaces.

In accordance with another aspect of this invention the method and means for moving the first and second surfaces with respect to one another includes means for rotating one of the first and second surfaces about an axis perpendicular to the other of the first and second surfaces.

Still another aspect of the present invention is the provision of a method and means for laterally confining the spheres in the space between the engaging members.

Another aspect of the present invention is the provision of relative movement between the sphere engaging means or confining means and the spheres.

In accordance with another aspect of the present invention at least three elastomeric spheres are confined with their diameters substantially aligned together and normal to the lateral confining means.

In yet another aspect of the present invention at least a pair of the elastomeric spheres have their diameters substantially aligned together and normal to the lateral confining means and wherein an auxiliary member is positioned in between and in contact with each sphere of the pair of spheres and connected to at least one of the first and second members.

Other aspects, features and advantages of the present invention will become more apparent upon perusal of the following specification taken in conjunction with the accompanying drawings wherein similar characters of reference designate similar elements and structures in each of the several views.

BRIEF DESCRIPTION OF THE DRAWINGS

FIG. 8 is a schematic side elevational, sectional view of the preferred embodiment of the present invention.

FIG. 11A is a view similar to FIG. 3 of still another embodiment of the present invention.

FIG. 11B is a side view of the structure shown in FIG. 11A taken along line B—B in the direction of the arrows.

DESCRIPTION OF THE PREFERRED EMBODIMENTS

While the present invention has many applications, the preferred embodiments take the form of hand operated exercise devices in which at least a pair of members movable relative to one another are coupled together through one or more elastomeric spheres utilizing rolling and/or sliding friction and compression of the spheres. The amount of friction and the degree of coupling between the members can be changed by changing the relative position of the members to change the compression of the spheres. One or more of the separate members can be held by the user and the members moved relative to one another to exercise various muscles of the user. The invention can take various different forms and different forms of the invention will be used to illustrate different applications and operations of the invention.

Figure 1:
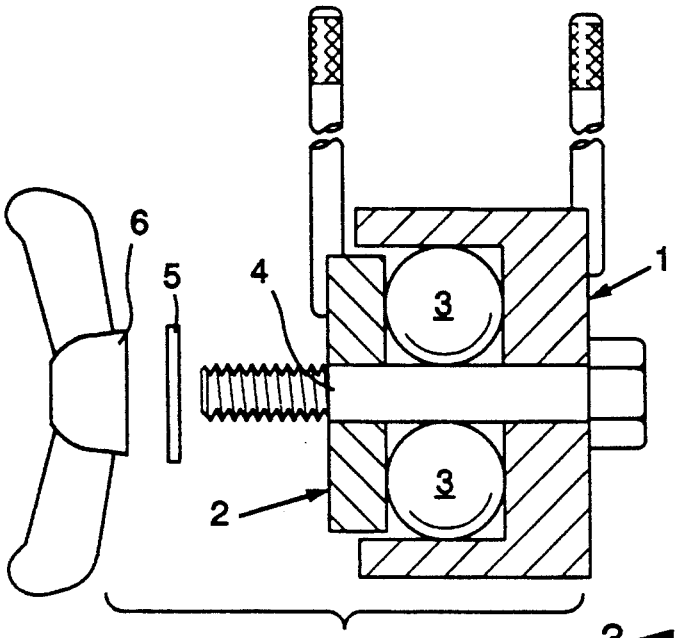
FIG. 1 is a schematic partially exposed, side elevational, sectional view of one embodiment of the present invention.

Returning now to the drawings initially with reference to FIG. 1, there is shown a hand operated exercise device having a first cup-shaped member 1 and a second plate member 2 sized to fit within the cup-shaped portion of member 1 against a plurality of elastomeric spheres 3. The spheres can be compressed to different selected degrees by clamping between the cup-shaped member 1 and plate 2 held together by an end threaded bolt 4 which extends axially through the cup-shaped member 1 and plate member 2 and onto which are provided a washer 5 and wing nut 6. Tightening the nut 6 onto bolt 4 compresses the elastomeric spheres 3. Operating handles 7 and 8 are mounted and project radially from the members 1 and 2 to be grasped by the operator. Relative movement on the handles 7 and 8 produces rotational movement of the members 1 and 2 and consequent rolling motion of the spheres 3. Resistance in movement of the handles 7 and 8 is caused by the rolling friction of the spheres 3 and the compression of different portions of the volume of the spheres 3 as the spheres roll in response to movement of the members 1 and 2. An exercise program for the user can be set up by changing the compression on the spheres.

It will be appreciated that the relative starting position of the handles 7 and 8 can be used to exercise different muscles. If the handles are initially side by side and parallel to one another and are rotated back and forth relative to one another, such as through a relative angle of 90°, certain muscles of the user are exercised. If the handles are parallel to one another but projecting in opposite directions so that there is an angle of 180° therebetween, movement of the handles will exercise different muscles. The handles can be provided with foot plates or linkages connected to foot plates so that the same device can be utilized for leg exercises. Alternatively, the user can strap one foot to a foot plate on one handle and operate the other handle by either or both of his arms to exercise still other muscles.

Preferably the spheres are of elastomeric materials as Buena-n, silicon rubber, plain rubber or the like.

Figure 2:
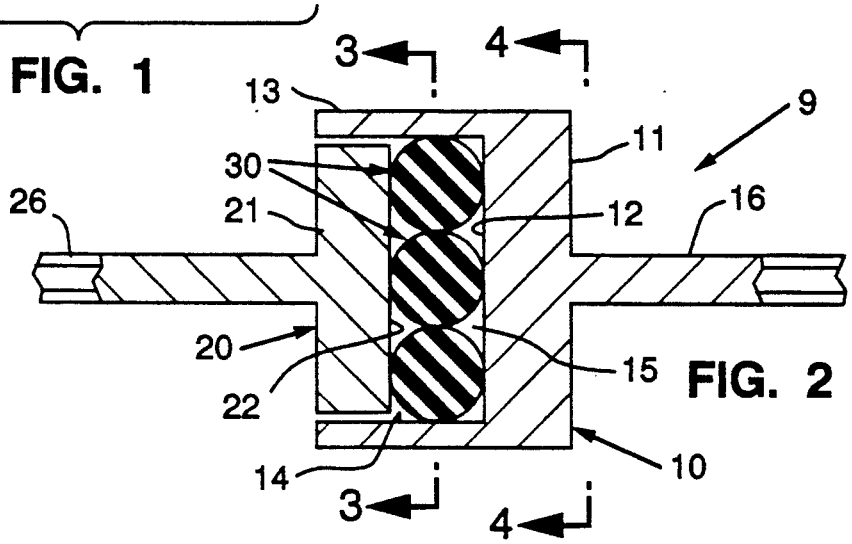
FIG. 2 is a schematic side elevational, sectional view of another embodiment of the present invention.
Figure 3:
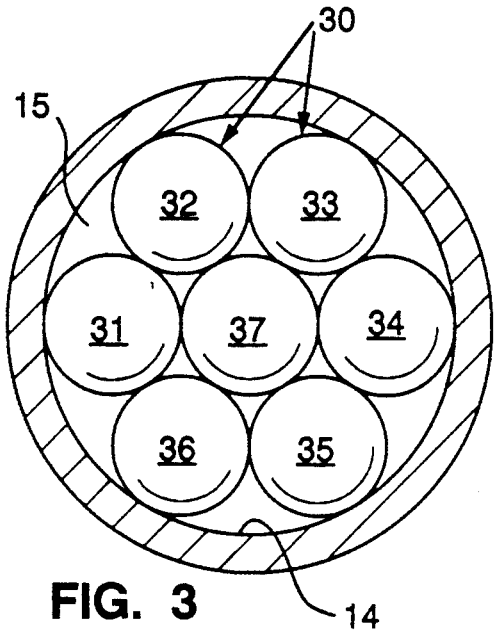
FIG. 3 is a sectional view of a portion of the structure shown in FIG. 2 taken along line 3—3 in the direction of the arrows.

Referring now to FIGS. 2 and 3, there is shown another exercise device 9 which incorporates other aspects of this invention and which includes a first cup-shaped container member 10 having a flat cylindrical base 11 attached at its periphery to a hollow cylindrical, lateral confining sidewall 13. A chamber or cavity 15 within the cup-shaped member 10 is defined by the inside surface 12 of the base member 11 and the inside surface 14 of the sidewall 13. A shaft 16, coaxial with the rotational axis of the cup-shaped container 10 and its cylindrical base member 11, extends from the base member 11 away from the chamber 15.

A piston member 20 on the end of a piston rod 26 is movably positioned within the sidewall 13 for longitudinal and rotational movement within the cup shaped member 10. The piston member 20 has a circular piston surface 22 facing the surface 12 of the base member 11.

A plurality of elastomeric spheres 30 are contained within the chamber 15. In the preferred embodiment of FIGS. 2 and 3 all of the spheres are of the same size, and all of the spheres will engage both of the surfaces 12 and 22 when these surfaces are spaced apart by the diameter of the spheres. There are seven spheres designated 31–37 in FIG. 3. Six of the spheres 31–36 circularly surround and contact a central sphere 37, and each of the surrounding six spheres 31–37 contacts two of the other surrounding spheres as well as the inside surface 14 of the cup-shaped member 10. Each sphere 30 also contacts the inside surface 12 of base member 11 and the surface 22 of the piston 21.

Means, not shown, provide a connection between the piston member 20 and the cup-shaped member 10, and this connection controls the relative axial position of the piston member 20 and container 10 to change the compression on the spheres. Increased compression will increase torque between members 10 and 20 or serve as a break. In a braking mode, continued compression of the nested elastomeric spheres 30 increases the sliding friction between the nested spheres 30 to increase the braking effect. In a power transfer mode, rotation of container shaft 16 serves as a drive unit to rotate piston shaft 26.

The connection between members 10 and 20 can take the form of support structures which position the members 10 and 20 at selected positions along a common access or can take the form of an adjustable arm which extends between members 10 and 20 and permits relative rotation of members 10 and 20 with different degrees of compression of spheres 30.

Movement applied at piston rod 26 toward the base surface 12 of the cup-shaped member 10 displaces piston 21 and compresses the elastomeric spheres 30 between surfaces 12 and 22. The spheres will flatten at their points of contact depending upon the compressibility of their materials. Adjusting the piston rod 26 to a desired position controls the amount of friction developed or between the cup-shaped member 10 and the piston member 20. The compressed spheres 30 act as the transferring agent for movement of one of these members to the other member which in the case of the exercise device of FIGS. 2 and 3 is relative rotational movement between engaging surface 12 and shaft 16 and engaging surface 22 and shaft 26. The nature of the spheres and the materials of the confining and/or compressing surfaces and the relative movement of the respective elements making up the assembly will determine the friction produced in the exercising device. Movement of piston 21 toward cup-shaped member 10 increases the torque applied from container shaft 16 to piston rod 26.

Figure 4:
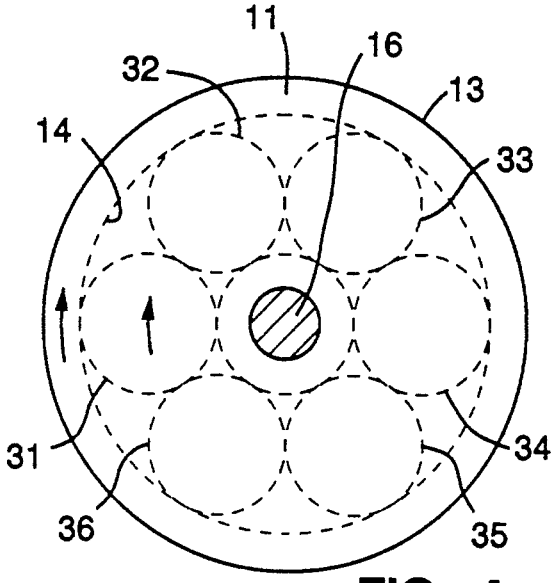
FIG. 4 is a schematic view of the portion of the structure shown in FIG. 2 taken along line 4—4 in the direction of the arrows.

When one sphere 31 is considered by itself, as shown in FIG. 4, in contact with the chamber surfaces 12 and 22 and relative motion is produced between surfaces 12 and 22 in a direction parallel to the plane of the surfaces 12 and 22, sphere 31 is urged to roll in the one indicated direction due to rolling friction at the points of contact of the sphere 31 with surfaces 12 and 22. Similarly, in the embodiment of FIGS. 2 and 3 and in the absence of contact with other elements, spheres 32 and 36 would roll in the same direction as sphere 31 rolls.

However, in the arrangement of seven spheres shown in FIGS. 3 and 4, sphere 31 also contacts spheres 32 and 36 at diametrically opposed points on the surface of sphere 31 and also contacts sphere 37 and the inside surface 14 of wall 13. Rolling movement of spheres 32 and 36 in the same direction as sphere 31 then encounters sliding friction at the points of contact between each of those spheres 32 and 36 with sphere 31. If alternate spheres in the ring of six spheres 31–36 had no contact with the surfaces 12 and 22, those alternate three spheres would roll in a direction opposite to the direction of the other three spheres in that ring. Also, in the embodiment of FIGS. 2 and 3 rolling movement of spheres 31–36 due to rolling friction with surfaces 12 and 22 would cause each of those spheres to rotate about the points of contact between that sphere and both the inside surface 14 of the sidewall 15 and the central sphere 37. And relative rotational movement of surfaces 12 and 22 urges central sphere 37 to rotate about the rotational axis of surfaces 12 and 22.

Figure 5:
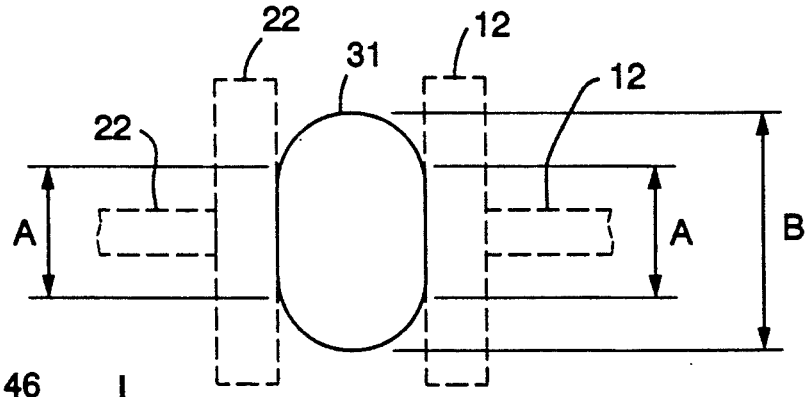
FIG. 5 is a schematic plan view illustrating other principles of the present invention.

When the distance between surfaces 12 and 22 is decreased to compress the spheres 31–37, the areas of contact for sliding friction will change and the distribution of those areas of contact between the various elements of the system will depend on the compressibility of the spheres. FIG. 5 illustrates an example of one elastomeric sphere 31 compressed between the two opposing surfaces 12 and 22. When surface 12 and surface 22 are moved towards each other to a distance substantially less than the diameter of sphere 31, the bearing surfaces of elastomeric sphere 31 increase equally as represented by A. Depending on the compressibility of the sphere 31 the sphere diameter increases to B. The principle represented schematically at FIG. 5 shows illustratively diametrical expansion of the elastomeric sphere 31. When elastomeric spheres 30 are contained in close proximity and placed in a state of compression, movement of the spheres will shift the compression, and relative movement will overcome sliding friction occurring between the elastomeric spheres. The principle of elastospherical kinetic friction disclosed herein is based on the adjustable containment of nested elastomeric spheres as described in the specification.

Preferably the spheres are all the same size and of the same material, but spheres of different sizes and compositions can be utilized for various different reasons. The spheres can be of Buna-n material, silicone rubber, plane rubber or the like. The spheres can be solid and can contain a core of a dissimilar material such as a different rubber, a plastic, a metal or a liquid, and the spheres can be hollow, either pressurized or nonpressurized. The surfaces 12, 22 and 14 can be of any appropriate material such as metal, plastic or hard rubber depending upon the desired characteristics for the exercise device 9. Either one or both of the engaging surfaces 12 and 22 can be concave or convex and the size of the spheres selected appropriate for these surface shapes.

Instead of being attached to the base member 11, the sidewall 13 could be an independent element in which case the spheres within the exercise device would be subjected to different frictional effects.

Figure 6:
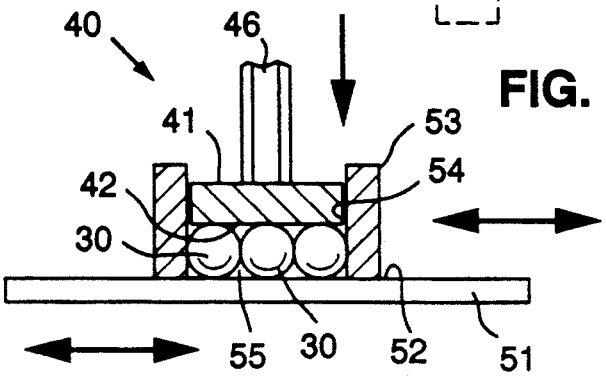
FIG. 6 is a schematic side elevational sectional view of another embodiment of the present invention.

Referring now to FIG. 6, there is shown another application and embodiment of the present invention. There, a piston member 40 having a piston 41 with a sphere contact surface 42 is mounted on a piston rod 46 for compressing an assembly of spheres 30 against the engaging surface 52 of a plate 51. A confining sidewall 53 has an interior surface 54 which laterally confines the spheres 30 in the cavity 55 between the engaging surfaces 42 and 52. The spheres 30 can be compressed by pressing the piston 41 in the direction of the engaging plate 51 and/or compressing the sidewall 53 against the spheres 30.

The arrangement of the spheres can be a rectilinear pattern in which case the sidewall 53 would take a rectilinear shape or in a circular pattern as the pattern of the embodiment of FIGS. 2 and 3, in which case the sidewall 53 would be cylindrical.

Movement of the spheres 30 or transfer of motion via these spheres 30 can be achieved by rectilinear motion of either plate 51 or piston member 40, or by rotation of the engaging surfaces 41 and/or 51.

Figure 7:
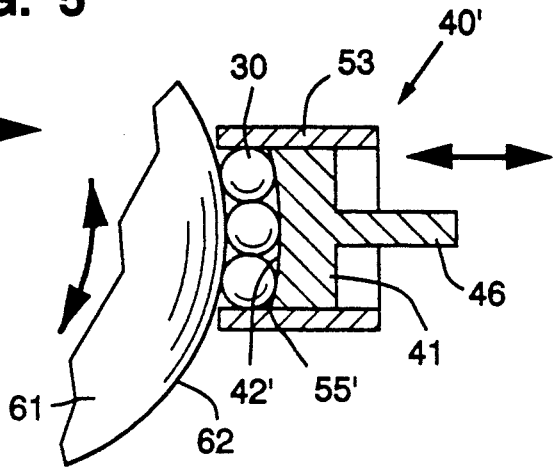
FIG. 7 is a schematic side elevational sectional view of still another embodiment of the present invention.

Referring now to FIG. 7 showing still another application and embodiment of the present invention wherein the piston member 40 and sidewall 53 can be employed to compress spheres 30 against a hemispherical surface 62 of a hemispherical or spherical member 61. The piston surface 42' is concave and can match the curvature of surface 62. Additionally or alternatively, in this embodiment the spheres centrally of the sphere array can be of lesser diameter. Spheres 30 freely moving in the uncompressed stated shown in FIG. 7 frictionally restricted by the adjustment of piston rod 46 to move piston 41 toward spherical structure 62. Elastomeric spheres 30 in chamber 55' retained by container wall 53 diametrically expand causing sliding friction between sphere surfaces and adjustable restrictive friction against the curved surface of spherical structure 61.

FIG. 8 shows the preferred embodiment of the present invention incorporating features described above and particularly with reference to FIG. 7. In FIG. 8 a spherical member 61', such as a full size bowling ball is supported on a base assembly 66 and is provided with an elongate operative handle 63 which can be grabbed and operated by the user to move the sphere 61 in various directions to exercise virtually all the different limb muscles of the user. A clamping structure is provided to hold the sphere 61 in its support structure and with a clamping means to provide variable clamping or drag force to the sphere as desired by the user. The clamping mechanism includes a pair of clamping assemblies 65 both or only one of which includes elastomeric spheres arranged for variable compression and moving friction as described above.

In this preferred embodiment the clamping structure 65 includes a hollow cylindrical confining wall 53' which is slotted at its top and bottom at 53'' to receive an actuating bar 74 which is connected to the piston plate 70 slidably received in the confining sidewall 53' to hold and compress a plurality of spheres 30 against the sphere 61'. The bar 74 is pivotally mounted on a shaft 75 between two upright flange members 76 which are laterally adjustably positioned on the base frame 66. A cam member 77 is slidably supported in the base 66 for bearing against the bottom end of the bar 74 to pivot the bar about the rod 75 to move piston member 70 toward and away from the sphere 61'. If the same compression assembly is utilized in both of the clamping assemblies 69, a pair of cam members 77 can operate simultaneously to increase or decrease the compression of the elastomeric spheres 30 against opposite sides of this sphere 61'. The base member can be positioned on a floor or can be mounted in a vertical, horizontal or arcuate track so that the handle 63 can be positioned for operation in all directions by the users arms or legs as desired.

Figure 9:
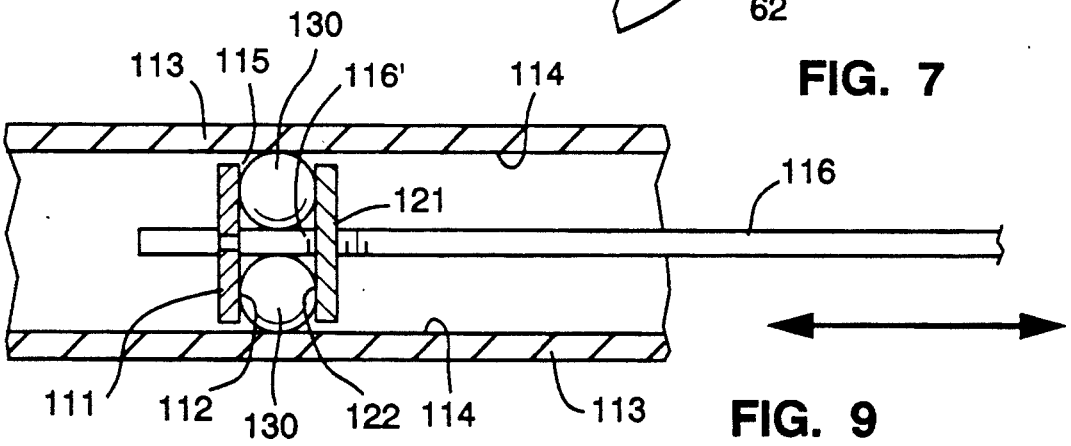
FIG. 9 is schematic side elevational sectional view of still another embodiment of the present invention.

Referring now to FIG. 9 there is illustrated an embodiment of the invention wherein an array of spheres 130 are clamped between the engaging surfaces 112 and 122 of a pair of spaced apart plates 111 and 121 respectively and the plates 121 and 122 can be translated along the axis of a hollow tubular member 113 which forms the confining sidewall surfaces 114 for the spheres 130. A shaft 116 threadably passes through the center of plate number 121 and is journaled in the plate 111 such that rotation of the shaft 116 can change the distance between plates 111 and 121 and thereby the compression on the spheres 130. As illustrated, the portion 116' of the rod 116 which passes through the cavity 115 between plates 111 and 121 serves as an auxiliary member engaging the surfaces of the spheres 130. In this embodiment the spheres 130 can be arranged in a ring around the shaft portion 116' for frictional engagement between the spheres 130 and the shaft portion 116'.

In this embodiment the assembly including the plates 111 and 121, the spheres 130 and the shaft 126 can be pulled longitudinally along the axis of the tubular member 113 for permitting a longitudinal exercising motion. During the longitudinal movement the elements within the tubular member 113 can be rotated for a rotational exercise in conjunction with a longitudinal exercising movement.

Figure 10:
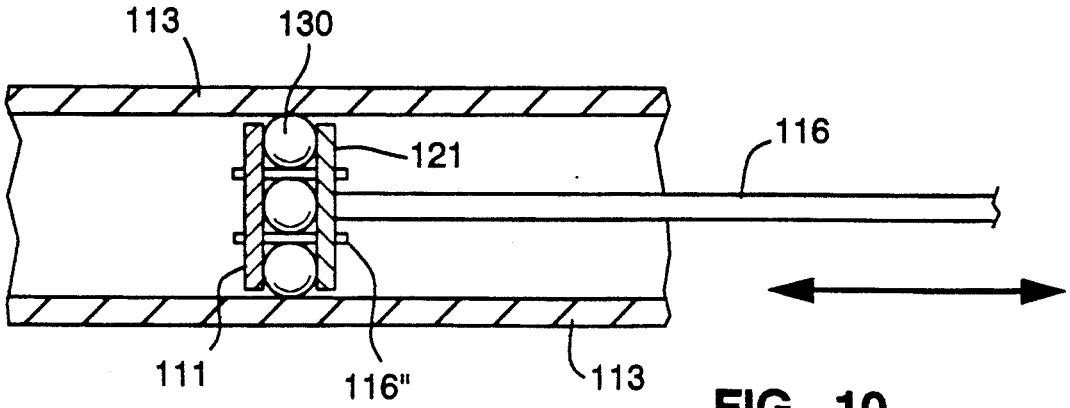
FIG. 10 is schematic side elevational sectional view of another embodiment of the present invention and illustrating an alternative structure for a portion of the embodiment shown in FIG. 9.

As an alternative to the construction shown in FIG. 9, a variable friction exercise device is shown in FIG. 10 and wherein the central auxiliary member portion of the shaft is replaced with a plurality of smaller spaced apart members (not shown) which hold the plates 111 and 121 at the desired spaced apart position and a central sphere is positioned within an array of six surrounding spheres so that the central sphere provides sliding friction with each of the surrounding spheres when the assembly is moved longitudinally of the surrounding hollow tubular sidewall 113.

As still another alternative embodiment of the present invention as shown in FIG. 11, a set of retainer rings can be connected together, such as by welding, to surround each of the elastomeric spheres in a closely grouped arrangement and prevent contact between adjacent spheres and avoid nonuniformity of friction due to the tendency of adjacent spheres to be moved in opposite directions. Thus, each sphere will encounter frictional forces with the ring which surrounds this sphere rather than with the adjacent spheres.

It will be appreciated that still other modifications could be made to the embodiments illustrated herein. For example, more than one layer of elastomeric spheres could be utilized. Thus, in the embodiment of FIGS. 1 and 2 a first layer of spheres 31–37 could be provided and a second layer of three spheres nested with the first layer and with the spheres of the second layer centered over three alternate spaces of the six spaces surrounding the central sphere 37 in between the surrounding spheres 31–36. A third layer of spheres would nest on top of the second layer in positions which are a projection of the positions of the first layer.

Although I have disclosed my principle and applications therefor with considerable detail in the specification, it is to be understood that number and size limitations are not imposed on the elastomeric spheres used and modifications thereto are permissible along with uses in other applications which may develop that do not deviate from the scope of the appended claims.

What I claim as my invention is:

1. A variable friction device comprising, in combination:

a first member having a first engaging surface, a second member having a second engaging surface, said first and second engaging surfaces of said first and second members spaced apart, at least one of said first and second members being a sphere with the engaging surface of said one member being spherical, at least one elastomeric sphere located between said first and second members and in contact with said first and second engaging surfaces, and means for moving one of said engaging surfaces or said elastomeric sphere relative to at least one of said first and second member, said at least one elastomeric sphere including a plurality of a elastomeric spheres located between said first and second members, each of said spheres in contact with both of said first and second engaging surfaces and with at least one other sphere and wherein said moving means moves said elastomeric sphere and said means for moving said elastomeric sphere causes the surfaces of said spheres to move with respect to said first and second surfaces and produces sliding friction between at least a pair of said spheres in contact with one another.

2. A variable friction device comprising, in combination:

a first member having a first engaging surface, a second member having a second engaging surface, said first and second engaging surfaces of said first and second members spaced apart, at least one of said first and second members being a sphere with the engaging surface of said one member being spherical, a plurality of elastomeric spheres located between said first and second members, means laterally of at least one of said first and said second engaging surfaces for confining said spheres in the space between said first and second engaging surfaces, each of said spheres in contact with both of said first and second engaging surfaces and with at least one other sphere, means for moving one of said engaging surfaces or said spheres relative to one of said laterally confining means, said first engaging surface and said second engaging surface to produce sliding friction between at least a pair of said spheres in contact with one another.

3. The device of claim 2 wherein at least one of said first and second surfaces is at least hemispherical.

4. A variable friction device comprising, in combination:

a first member having a first engaging surface, a second member having a second engaging surface, said first and second engaging surfaces of said first and second members spaced apart, at least one of said first and second members being a sphere with the engaging surface of said one member being spherical, a plurality of elastomeric spheres located between said first and second members, means laterally of at least one of said first and said second engaging surfaces for confining said spheres in the space between said first and second engaging surfaces, each of said spheres in contact with both of said first and second engaging surfaces and with at least one other sphere, means for moving one of said engaging surfaces or said spheres relative to one of said laterally confining means, said first engaging surface and said second engaging surface to produce sliding friction between at least a pair of said spheres in contact with one another and means for moving said first and second members relative to one another in the direction of the shortest distance between said first and second services of said first and second members to change the compression on said spheres by said first and second members.

5. A variable friction device comprising, in combination:

a first member having a first engaging surface, a second member having a second engaging surface, said first and second engaging surfaces of said first and second members spaced apart, at least one of said first and second members being a sphere with the engaging surface of said one member being spherical, a plurality of elastomeric spheres located between said first and second members, means laterally of at least one of said first and said second engaging surfaces for confining said spheres in the space between said first and second engaging surfaces, each of said spheres in contact with both of said first and second engaging surfaces and with at least one other sphere, means for moving one of said engaging surfaces or said spheres relative to one of said laterally confining means, said first engaging surface and said second engaging surface to produce sliding friction between at least a pair of said spheres in contact with one another and said moving means moving said elastomeric spheres, said means for moving said elastomeric spheres including means for moving one of said first and second engaging surfaces at the point of contact of said one of said first and second engaging surfaces with at least one of said elastomeric spheres in a direction parallel to the plane of the other of said engaging surfaces at the point of contact of said engaging surface with said one elastomeric sphere.

6. A variable friction device comprising, in combination:

a first member having a first engaging surface, a second member having a second engaging surface, said first and second engaging surfaces of said first and second members spaced apart, at least one of said first and second members being a sphere with the engaging surface of said one member being spherical, a plurality of elastomeric spheres located between said first and second members, means laterally of at least one of said first and said second engaging surfaces for confining said spheres in the space between said first and second engaging surfaces, each of said spheres in contact with both of said first and second engaging surfaces and with at least one other sphere, means for moving one of said engaging surfaces or said spheres relative to one of said laterally confining means, said first engaging surface and said second engaging surface to produce sliding friction between at least a pair of said spheres in contact with one another and said moving means moving said elastomeric spheres, said means for moving said elastomeric spheres including means for moving at least one of said first and second engaging services relative to said lateral confining means.

7. A variable friction device comprising, in combination:

a first member having a first engaging surface, a second member having a second engaging surface, said first and second engaging surfaces of said first and second members spaced apart, at least one of said first and second members being a sphere with the engaging surface of said one member being spherical, a plurality of elastomeric spheres located between said first and second members, means laterally of at least one of said first and said second engaging surfaces for confining said spheres in the space between said first and second engaging surfaces, each of said spheres in contact with both of said first and second engaging surfaces and with at least one other sphere, means for moving one of said engaging surfaces or said spheres relative to one of said laterally confining means, said first engaging surface and said second engaging surface to produce sliding friction between at least a pair of said spheres in contact with one another, said means for moving said elastomeric spheres including means for removing both of said first and second surfaces relative to said lateral confining means.

8. The device of claim 2 including at least three elastomeric spheres having their diameters substantially aligned together and normal to said lateral confining means.

* * * * *